US006607340B2

(12) United States Patent
Petzl et al.

(10) Patent No.: US 6,607,340 B2
(45) Date of Patent: Aug. 19, 2003

(54) REMOVABLE ICE SCREW SECURING DEVICE EQUIPPED WITH A QUICKDRAW

(75) Inventors: Paul Petzl, Barraux (FR); Jean Marc Hede, Le Touvet (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 09/814,803

(22) Filed: Mar. 23, 2001

(65) Prior Publication Data

US 2001/0024608 A1 Sep. 27, 2001

(30) Foreign Application Priority Data

Mar. 23, 2000 (FR) ..... 00 03742

(51) Int. Cl.[7] ..... F16B 45/00
(52) U.S. Cl. ..... 411/400; 411/409; 248/231.9
(58) Field of Search ..... 411/402, 409, 411/400, 401; 74/545; 248/231.9, 925

(56) References Cited

U.S. PATENT DOCUMENTS 1,170,344 A * 2/1916 Ryan
4,074,519 A * 2/1978 Garrett
4,918,784 A * 4/1990 Cude
5,118,061 A * 6/1992 Byrne
5,183,360 A * 2/1993 Freeman
5,433,394 A * 7/1995 Brozio
5,782,442 A * 7/1998 Kwak
6,022,164 A * 2/2000 Tsui

FOREIGN PATENT DOCUMENTS

| | | |
|---|---|---|
| DE | C1 43 04 618 | 3/1994 |
| DE | U1 297 12 009 | 10/1997 |
| FR | A1 2 568 131 | 1/1986 |
| FR | A1 2 709 972 | 3/1995 |

* cited by examiner

*Primary Examiner*—Flemming Saether
(74) *Attorney, Agent, or Firm*—Oliff & Berridge, PLC

(57) ABSTRACT

The invention relates to a securing device to be screwed in having an attachment lug equipped with a movable fixing means designed to prevent any twisting effect of the quickdraw when rotation of the ice peg takes place. The fixing means is formed by a cylindrical stud mounted rotating freely on a spindle securedly affixed to the attachment lug. The stud acts as operating handle for driving the securing device in rotation whereas the quickdraw remains permanently attached to the lug.

9 Claims, 5 Drawing Sheets

REMOVABLE ICE SCREW SECURING DEVICE EQUIPPED WITH A QUICKDRAW

BACKGROUND OF THE INVENTION

The invention relates to a removable securing device, and more specifically, a removable ice screw securing device equipped with a quickdraw.

The use of tubular ice pegs for belaying mountaineers in icy terrain is well known. The body of the metal tube generally presents the same diameter from the head down to the bit. The same is true for the spiral thread which has the same external diameter over the whole threaded length of the first part of the tube. Such a structure requires rotational driving forces appreciably proportional to the hardness of the ice. On ice slopes of maximum hardness, these forces become extremely great and it is indispensable to screw the peg in and out by hand, preferably by means of the attachment lug or by means of the ice-axe acting as leverage arm.

In FIG. 1, the ice peg according to the document FR-A-2,709,972 (Charlet-Moser) comprises an elongate tube 12 or body of cylindrical cross-section extending along a longitudinal axis 14. A hollow head 16 equipped with an attachment lug 18 is located at the upper part of the tube 12, which lug comprises a driving base-part 20 mounted with clearance on a flat surface 21 of the head 16, and a twisted extension 22 provided with at least one hole 24 for a snap-hook or a means for driving the peg 10 in rotation to pass through. A gripping knob in the form of a wheel can be mounted rotating freely on a spindle securedly affixed to the extension 22 of the attachment lug 18, and the driving base-part 20 extends perpendicularly to the longitudinal axis 14 of the tube 12. The bottom end of the hollow tube 12 comprises a hollow cylindrical bit 32 equipped with a plurality of sharp cutting teeth designed to bore a circular hole in the ice when the peg 10 is screwed in. A self-tapping spiral thread 36 extends along a first part 12*a* on the bottom portion of the tube 12, in the extension of the bit 32. The other second upper part 12*b* of the tube 12, situated between the beginning of the thread 36 and the head 16, presents a smooth external lateral surface. Screwing of the peg into the ice is performed by a manual rotation action of the attachment lug 18, by means of the gripping knob, or of a leverage arm formed by inserting an ice-axe into the hole 24. The inside of the tube 12 is hollow from the head 16 down to the bit 32 so as to enable the ice core to be removed upwards as the peg 10 is progressively screwed into the ice.

To attach the rope to the ice wall, the mountaineer screws the peg in by hand and then fits a joining quickdraw between the attachment lug 18 and the rope.

Such a technique for screwing ice pegs into the ice presents two drawbacks:

(1) during the driving-in travel of the thread 36 into the ice, the mountaineer has to let go of the peg 10 at each half-turn of the attachment lug 18 in the absence of a knob;

(2) to avoid twisting of the quickdraw in the course of rotation of the attachment head 18, it is standard practice to fit the quickdraw when the peg has reached the end of its screwing-in travel. If the mountaineer accidentally lets go of the attachment head 18 at the beginning of screwing-in, nothing will stop the peg 10 from falling and being lost. The same risk exists when performing unscrewing of the peg which requires the snap-hook to be removed from the quickdraw.

To overcome the first drawback, it has been proposed to continuously actuate either the wheel of the document FR-A-2,709,972, or as shown in FIG. 2, a retractable finger 23 articulated on the attachment lug and forming a crank-handle in the raised position. The latter technique is described in detail in the document FR-A-2,758,992 (Black Diamond). Other manufacturers propose a crank-handle able to be fitted on the attachment lug when screwing-in is performed, and which can be detached after screwing-in has been completed.

The second drawback has not been overcome, as the attachment point of the quickdraw or of its snap-hook is formed by the hole 24 arranged in the fixed extension 22 of the attachment lug 18.

SUMMARY OF THE INVENTION

The object of the invention is to overcome the two above-mentioned drawbacks and to achieve a securing device which is easy to fit and to retrieve, and which remains captively secured during the screwing-in and unscrewing operations.

The securing device according to the invention is characterized in that the attachment lug comprises a movable fixing means designed to prevent any twisting effect of the quickdraw when rotation of the Ice peg takes place. The continuous presence of the quickdraw provides total safety for the user right from the moment he begins screwing the securing device in.

According to a preferred embodiment of the invention, the fixing means is formed by a stud mounted rotating freely on a spindle fixedly secured to the attachment lug, said stud acting at the same time as operating handle for driving in rotation. The support spindle of the stud extends parallel to the longitudinal axis of the tube with a transverse offset corresponding to the leverage arm of the attachment lug.

According to one feature of the invention, the stud comprises a smooth cylindrical surface around which a loop of the quickdraw is fitted.

According to another feature of the invention, the rotating stud is equipped with a hole for insertion of a snap-hook of the quickdraw, said hole being orthogonal with respect to the longitudinal axis of the tube.

According to another feature of the invention, an additional base-part Is mounted rotating freely on the spindle and is provided with a hole to receive either a snap-hook inserted in the hole or the strap of a quickdraw directly fitted around the stud.

BRIEF DESCRIPTION OF THE DRAWINGS

Other advantages and features will become more clearly apparent from the following description of different embodiments of the invention, given as non-restrictive examples only and represented in the accompanying drawings, in which.

DESCRIPTION OF THE PREFERRED EMBODIMENTS

In the following, the securing device is described with reference to an ice peg. The same reference numbers will be used in FIGS. 3 to 5 to designate identical parts to those described previously.

Figure 3:
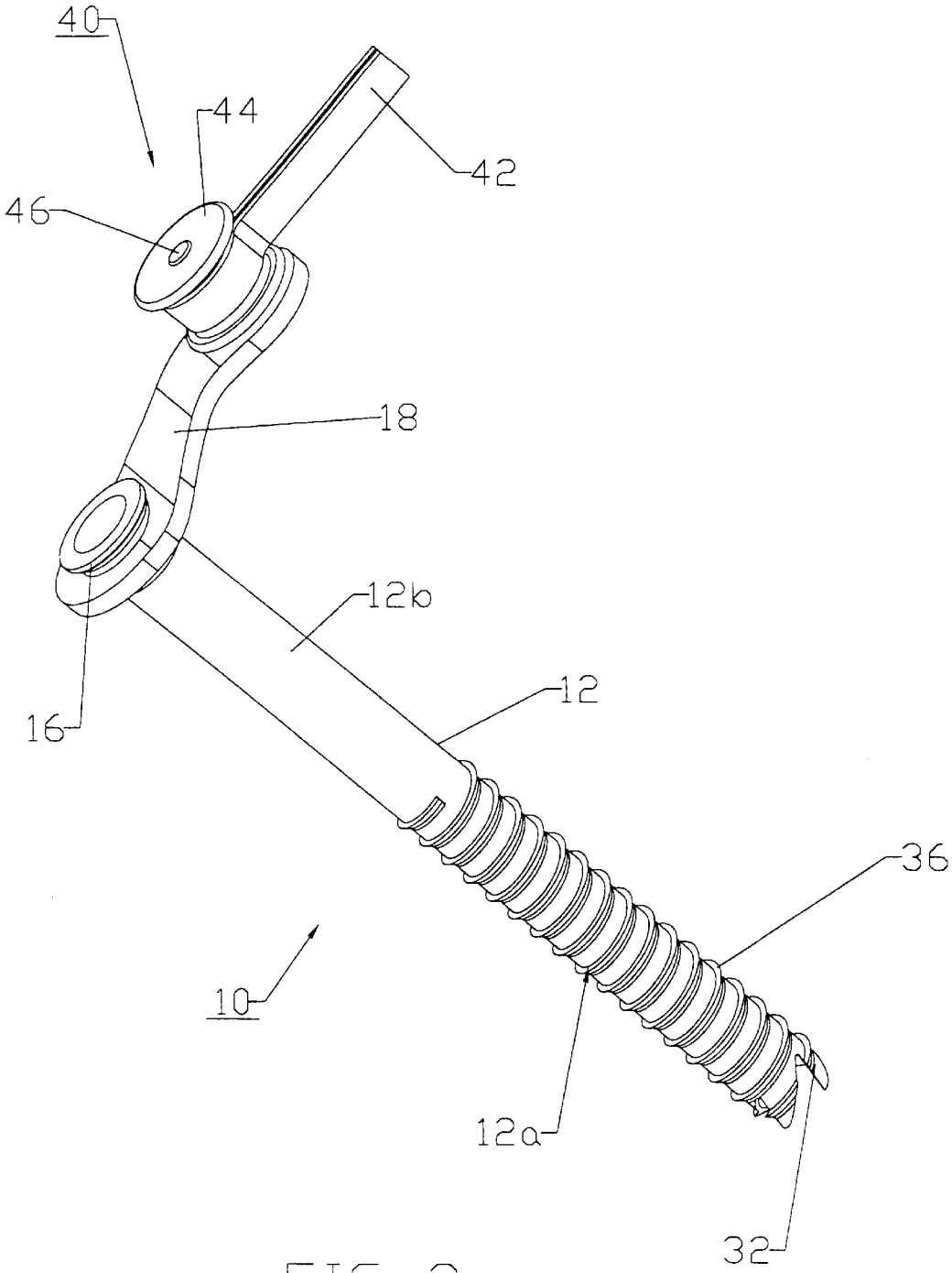
FIG. 3 represents a perspective view of an ice peg according to the invention.

In FIG. 3, the attachment lug 18 of the quickdraw comprises a movable fixing means 40 preventing any twisting effect of the quickdraw when rotation of the peg 10 takes place. The fixing means 40 is formed by a cylindrical stud 44 mounted rotating freely on a spindle 46 of the attachment lug 18. The spindle 46 extends appreciably parallel to the longitudinal axis 14 of the tube 12 with a transverse offset corresponding to the leverage arm of the attachment lug 18. The quickdraw 42 is formed by a strap sewn around the stud 44 and forming a closed loop. The stud 44 acts as gripping handle for driving the attachment lug 18 in rotation whereas the quickdraw 42 remains permanently attached without twisting.

Figure 1:
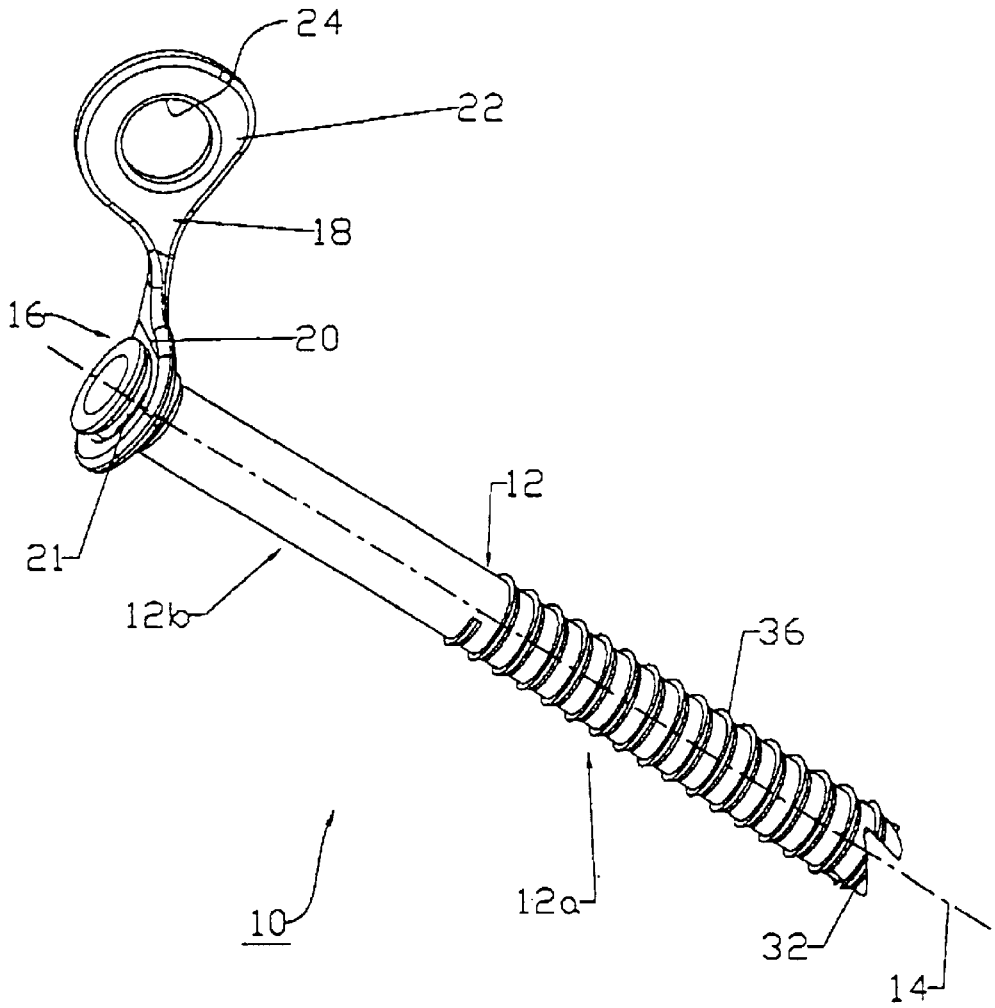
FIG 1 PRIOR ART
FIG. 1 is a perspective view of an ice peg of the prior art described in the document FR-A-2,709,972.
Figure 2:
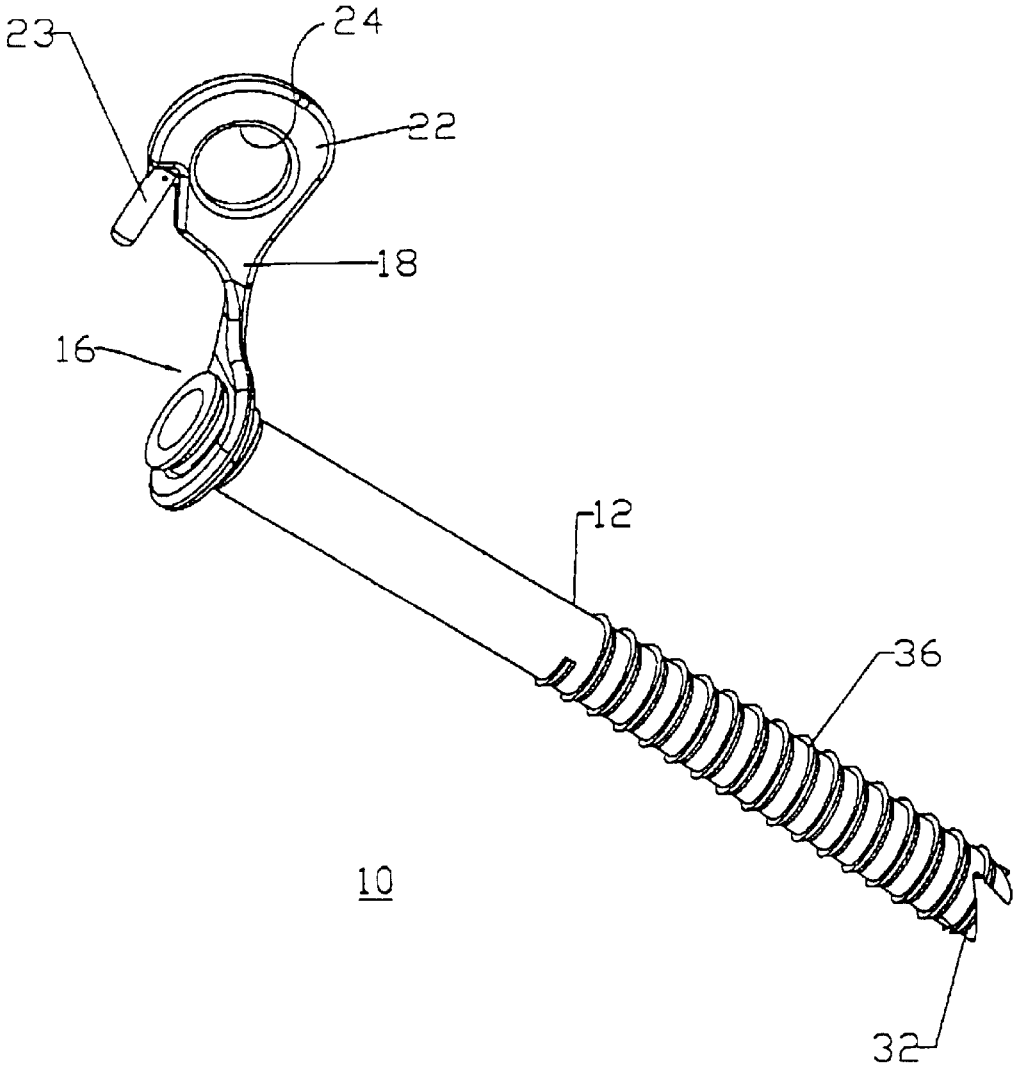
FIG 2 PRIOR ART
FIG. 2 shows another ice peg of the prior art illustrated in the document FRA-2,758,992.
Figure 4:
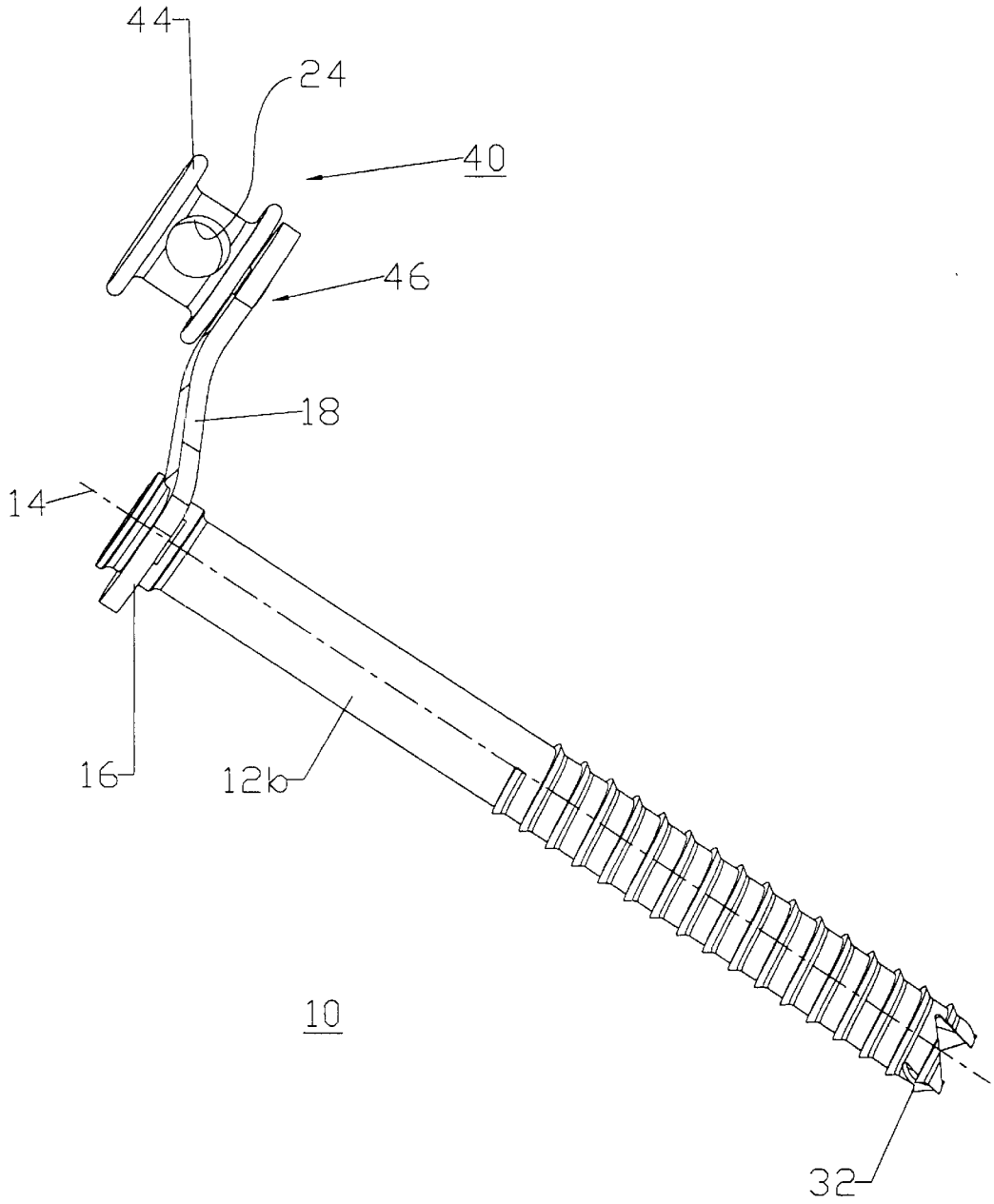
FIGS. 4 and 5 are identical views to FIG. 3 of two alternative embodiments.

With reference to FIG. 4, the hole 24 for passage of a snap-hook of the quickdraw is provided in the rotating stud 44 instead of being arranged in fixed manner in the twisted lug of FIGS. 1 and 2. The hole 24 presents an appreciably orthogonal axis with respect to the longitudinal axis 14 of the tube 12.

Figure 5:
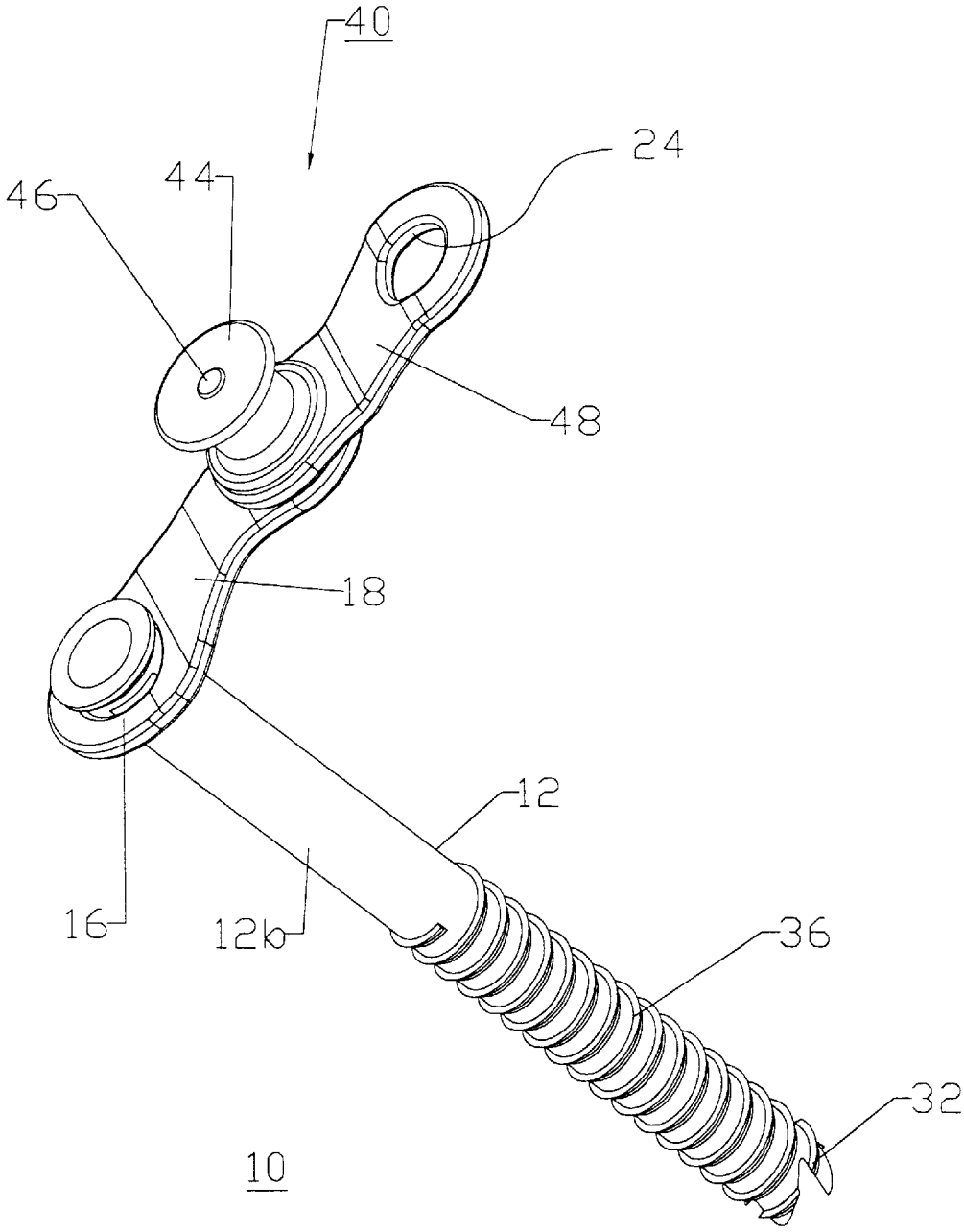

In FIG. 5, the rotating stud 44 of FIG. 3 is equipped with an additional base-pan 48 provided with the hole 24. The base-part 48 is mounted rotating freely on the spindle 46 and enables either a snap-hook inserted in the hole 24 or the strap of a quickdraw sewn directly around the stud 44 or sewn into the hole 24 to be received. The base-part 48 is fitted intercalated between the attachment lug 18 and the stud 44, the axis of the hole 24 being parallel to the support spindle 46 of the stud 44.

According to another alternative embodiment (not represented), the movable fixing means 40 of the quickdraw 42 comprises a multidirectional link with a swivel joint.

Instead of an ice peg, the removable securing device can be formed by an elongate screw designed to be screwed into a threaded insert which is anchored In the rock or a fixed support structure.

What is claimed is:

1. A removable securing device having a tubular metal body extending along a longitudinal axis, comprising:

a spiral thread arranged around a first bottom part of the body;

a head equipped with a lug;

a rotatable fixing means mounted on the lug to prevent any twisting effect of a quickdraw when rotation of the head takes place; and means for attaching the quickdraw to perform screwing of the body when the head is moved in rotation.

2. The securing device according to claim 1, wherein the fixing means is formed by a stud mounted rotating freely on a spindle fixedly secured to the attachment lug, said stud acting at the same time as operating handle for driving in rotation.

3. The securing device according to claim 2, wherein the support spindle of the stud extends parallel to the longitudinal axis of the body with a transverse offset corresponding to a leverage arm of the attachment lug.

4. The securing device according to claim 2, wherein the stud comprises a smooth cylindrical surface around which a loop of the quickdraw is fitted.

5. The securing device according to claim 2, wherein the rotating stud is equipped with a hole for insertion of a snap-hook of the quickdraw, said hole being appreciably orthogonal with respect to the longitudinal axis of the body.

6. The securing device according to claim 2, wherein an additional base-part is mounted rotating freely on the spindle and is provided with a hole to receive the quickdraw directly sewn around the stud or inserted in said hole.

7. The securing device according to claim 6, wherein the base-part is fitted intercalated between the attachment lug and the stud, the axis of the hole being appreciably parallel to the support spindle of the stud.

8. The securing device according to claim 1, wherein the body is formed by a tube of an ice peg comprising a self-tapping thread and a bit to bore a hole in the ice when the driving-in travel of the tube takes place.

9. The securing device according to claim 1, wherein the body is formed by an elongate screw designed to be screwed into a threaded insert anchored in a fixed support structure.

* * * * *